US007032551B2

(12) United States Patent
Eguchi et al.

(10) Patent No.: US 7,032,551 B2
(45) Date of Patent: Apr. 25, 2006

(54) ADJUSTING MECHANISM ADJUSTING METHOD OF VALVE-LIFT AMOUNT OF INTERNAL COMBUSTION ENGINE

(75) Inventors: Kaoru Eguchi, Tokyo (JP); Masaru Nemoto, Yokohama (JP); Yoshihiko Yamada, Fujisawa (JP); Tamotsu Todo, Atsugi (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/068,928

(22) Filed: Mar. 2, 2005

(65) Prior Publication Data

US 2005/0199199 A1 Sep. 15, 2005

(30) Foreign Application Priority Data

Mar. 12, 2004 (JP) ..... 2004-070864

(51) Int. Cl.
*F01L 1/34* (2006.01)

(52) U.S. Cl. ..... 123/90.16; 123/90.15; 123/90.31; 123/90.39

(58) Field of Classification Search ..... 123/90.16, 123/90.15, 90.31, 90.39
See application file for complete search history.

(56) References Cited

U.S. PATENT DOCUMENTS 5,018,487 A * 5/1991 Shinkai ..... 123/90.16
5,148,783 A * 9/1992 Shinkai et al. ..... 123/90.16

FOREIGN PATENT DOCUMENTS

JP 11-107725 A 4/1999
JP 2002-221014 A 8/2002

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

A rocker arm 13 is rocked with respect to a control shaft 32 through a link arm 14 by rotation of a drive shaft 3. With this configuration, a rocking cam 7 is rocked with respect to the drive shaft 3 through a link member 15. A valve lifter 6 is pushed downward by rocking of the rocking cam 7. The control shaft 32 is integrally provided with a control cam which is eccentric with respect to an axis of the control shaft 32. If the control cam is rotated, a rocking fulcrum position of the rocker arm 13 is changed, thereby varying a valve-lift amount. An eccentric bush 22 is provided on an inner peripheral surface of the rocker arm 13 on an outer periphery side of the control cam. The eccentric bush 22 meshes with an inner peripheral gear formed on an inner periphery of the rocker arm 13 by an outer peripheral gear 39*b*, and is coupled to the rocker arm 13. This coupled state is released by moving the eccentric bush 22 in the axial direction. In this state, the eccentric bush 22 is rotated by a predetermined amount with respect to the control cam and the rocker arm 13, thereby adjusting the valve-lift amount.

7 Claims, 6 Drawing Sheets

ADJUSTING MECHANISM ADJUSTING METHOD OF VALVE-LIFT AMOUNT OF INTERNAL COMBUSTION ENGINE

BACKGROUND OF THE INVENTION

The present invention relates to an adjusting mechanism and an adjusting method of a valve-lift amount of an internal combustion engine for rocking a rocker arm when a camshaft is rotated and for rocking a rocking cam provided on the camshaft to open and close a valve.

To enhance engine performances, there is a known valve operating mechanism which variably controls a valve-lift amount corresponding to variation of an engine operating state as disclosed in Japanese Patent Applications Laid-open Nos. 2002-221014 and H11-107725. According to this valve operating mechanism, a rocking cam opens and closes a suction valve by a rotation force transmitted, through a rocker arm or a link member, from a drive cam which is an eccentric rotation cam provided on a camshaft. The valve operating mechanism controls rotation of a control cam on an outer periphery of a control shaft disposed in parallel to the camshaft and changes a rocking fulcrum of the rocker arm, thereby varying the valve-lift amount corresponding to the engine operating state.

SUMMARY OF THE INVENTION

In the conventional valve operating mechanism, since the valve-lift amount is determined by size precision of link parts, the valve-lift amounts are varied between cylinders depending upon the size precision. In the operation for appropriately adjusting the valve-lift amount, it is necessary that the valve-lift amount is measured in a state where the valve operating mechanism is assembled and then the valve operating mechanism is disassembled and a link member is replaced by another link member having different length, and this deteriorates the operation efficiency.

The present invention has been achieved in order to solve the above problem, and it is an object of the invention to provide an adjusting mechanism and an adjusting method of a valve-lift amount for easily adjusting the valve-lift amount.

As the most essential feature, the present invention provides a valve-lift amount adjusting mechanism of an internal combustion engine in which a rocker arm is rocked with respect to a rocking support shaft when a camshaft rotates, a rocking cam provided on the camshaft is rocked when the rocker arm rocks, thereby opening and closing a valve, wherein the rocker arm is rockably supported with respect to the rocking support shaft through an eccentric bush, a coupling portion is provided between the eccentric bush and the rocker arm, the coupling portion can switch between a state where the eccentric bush and the rocker arm can integrally rock with respect to the rocking support shaft and a state where the eccentric bush and the rocker arm can relatively rotate.

DETAILED DESCRIPTION OF THE PREFERRED EMBODIMENTS

An embodiment of the present invention will be explained below with reference to the accompanying drawings.

Figure 1:
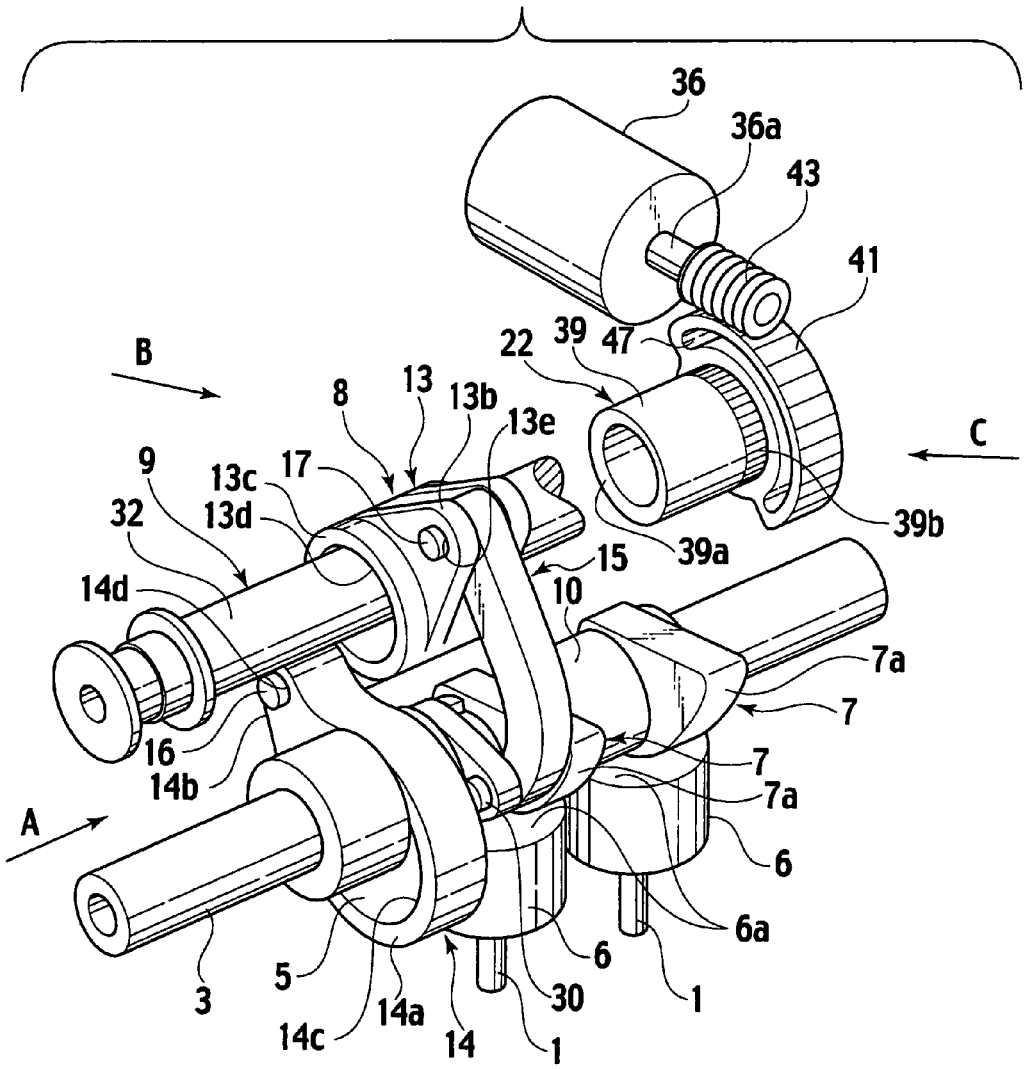
FIG. 1 is a perspective view of a valve operating mechanism having a valve-lift amount adjusting mechanism of an internal combustion engine according to an embodiment of the invention, when the valve-lift amount of the valve operating mechanism is adjusted.
Figure 2:
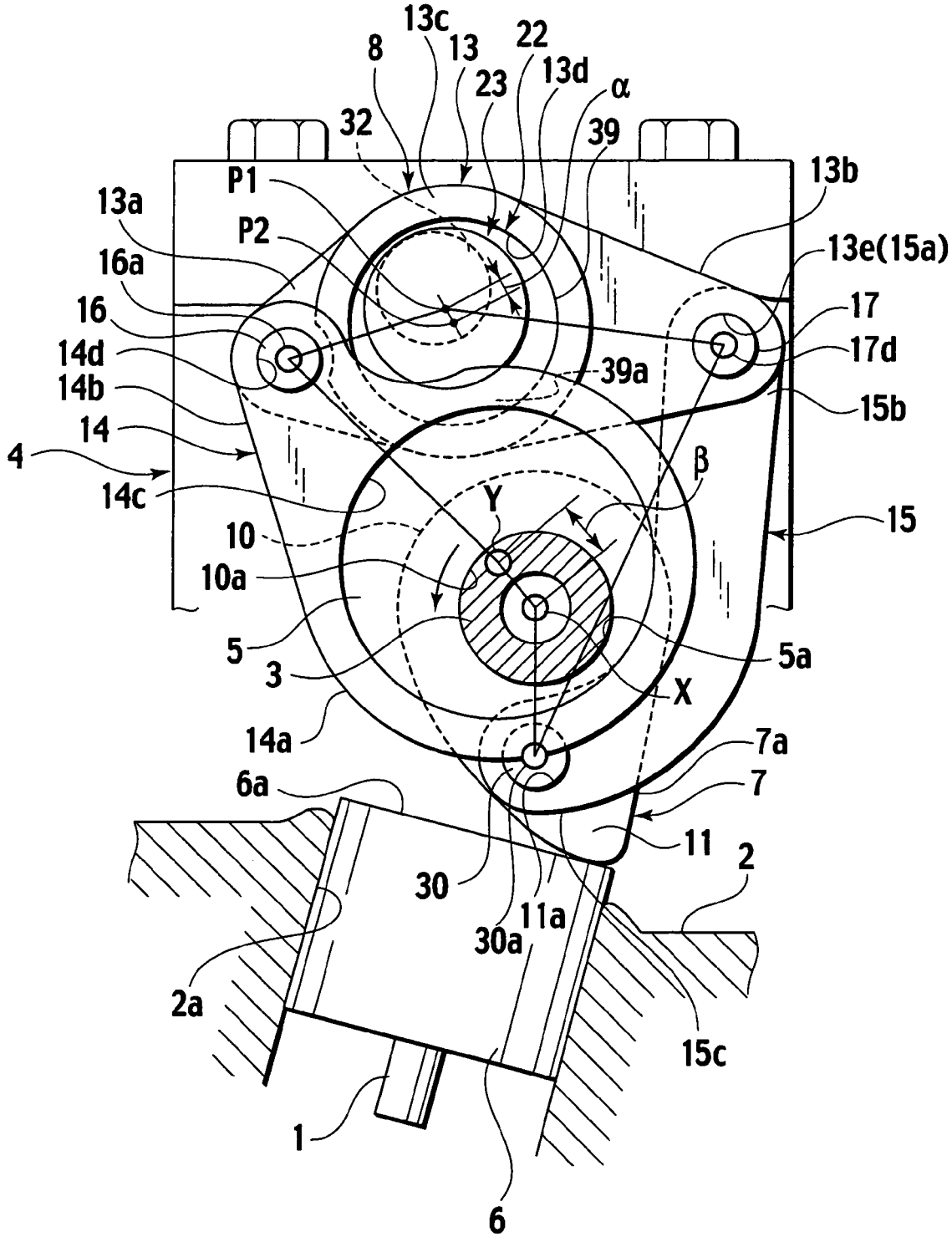
FIG. 2 is a sectional view taken along an arrow A in FIG. 1.

FIG. 1 is a perspective view of a valve operating mechanism having a valve-lift amount adjusting mechanism of an internal combustion engine according to an embodiment of the invention, when the valve-lift amount of the valve operating mechanism is adjusted. FIG. 2 is a sectional view taken along an arrow A in FIG. 1. The valve operating mechanism is applied to a suction side of the engine. The valve operating mechanism includes two suction valves 1 for each cylinder, and variable valve operating mechanisms. Each variable valve operating mechanism varies a valve-lift amount of each suction valve 1 corresponding to an engine operating state.

That is, each of the variable valve operating mechanisms includes the pair of suction valves 1 which are slidably provided on a cylinder head 2 through valve guides and which are biased in their closing direction by spring force of a valve spring, a drive shaft 3 as a hollow camshaft rotatably supported by a bearing 4 provided at an upper portion of the cylinder head 2, a drive cam 5 which is an eccentric rotation cam fixed to the drive shaft 3, a rocking cam 7 which is rockably supported by an outer periphery of the drive shaft 3 and which comes into slide contact with an upper surface 6*a* of a valve lifter 6 disposed on an upper end of each suction valve 1, a transmitting mechanism 8 which is associated between the drive cam 5 and the rocking cam 7 for transmitting rotation force of the drive cam 5 as a rocking force of the rocking cam 7, and a control mechanism 9 which controls an operation position of the transmitting mechanism 8.

The drive shaft 3 is disposed along a longitudinal direction of the engine. The rotation force is transmitted to the drive shaft 3 from a crankshaft of the engine through a follower sprocket (not shown) provided on one end of the drive shaft 3 and a timing chain wound around the follower sprocket. The rotation direction is the counterclockwise direction (direction shown with an arrow in FIG. 2).

The drive cam 5 is made of wear resistant material and formed into substantially cylindrical shape. As shown in FIG. 2, a drive shaft-inserting hole 5*a* is formed in the drive cam 5 such as to penetrate the drive cam 5 in its axial direction. A center of the drive shaft-inserting hole 5*a* is deviated from an axis X of the drive shaft 3 in a radial direction by a predetermined amount $\beta$. The drive cam 5 is fixed to the drive shaft 3, and as the drive shaft 3 rotates, the drive cam 5 rotates in the counterclockwise direction in FIG. 2.

The valve lifter 6 is formed into a bottomed cylindrical shape, and is slidably held in a holding hole 2*a* of the cylinder head 2. The upper surface 6*a* of the valve lifter 6 is formed flatly. Later-described cam bodies 7*a* of the rocking cams 7 come into slide contact with the upper surface 6*a*.

The rocking cams 7 respectively have cam bodies 7*a*. The cam bodies 7*a* are integrally provided on both ends of a cylindrical base 10. Each cam body 7*a* is formed into a raindrop shape. A support hole is formed in the base 10 in its axial direction. The entire drive shaft 3 is inserted into the support hole and is rockably supported therein. One of the two rocking cams 7 is formed at its one end with a cam nose 11, and a pin hole 11*a* is formed in the cam nose 11 such as to penetrate the cam nose 11. A cam face formed on a lower surface of each cam body 7*a* abuts against a predetermined position of the upper surface 6*a* of each valve lifter 6, thereby varying valve lift characteristics.

The transmitting mechanism 8 includes a rocker arm 13 disposed above the drive shaft 3, a link arm 14 which connects one end 13*a* of the rocker arm 13 and the drive cam 5 to each other, and a link member 15 which connects the other end 13*b* of the rocker arm 13 and the rocking cam 7 to each other.

The rocker arm 13 is provided at its center with a cylindrical base portion 13*c*. The cylindrical base portion 13*c* and a later-described eccentric bush 22 are integrally coupled to each other and are rotatably supported by a control cam 23 as an eccentric cam.

The cylindrical base portion 13*c* formed at the center of the rocker arm 13 includes a support hole 13*d*. The eccentric bush 22 is fixed and coupled to the support hole 13*d* (this coupled state is released in FIG. 1) and in this state, the rocker arm 13 is rockably supported integrally with the eccentric bush 22 with respect to a control cam 23 of a control shaft 32 as a later-described rocking support shaft.

Figure 3:
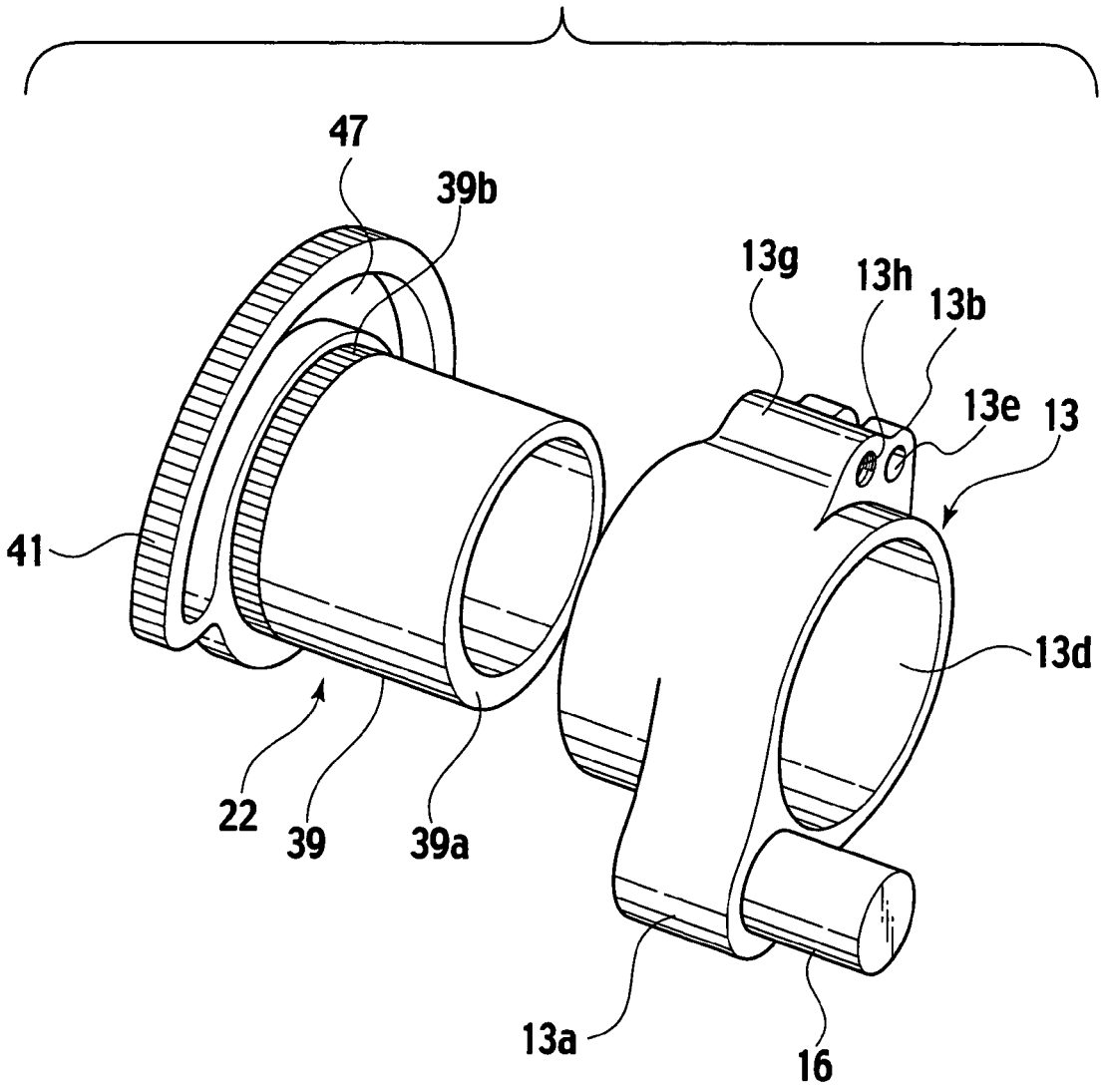
FIG. 3 is an exploded perspective view of a rocker arm and an eccentric bush taken along an arrow B in FIG. 1.
Figure 4:
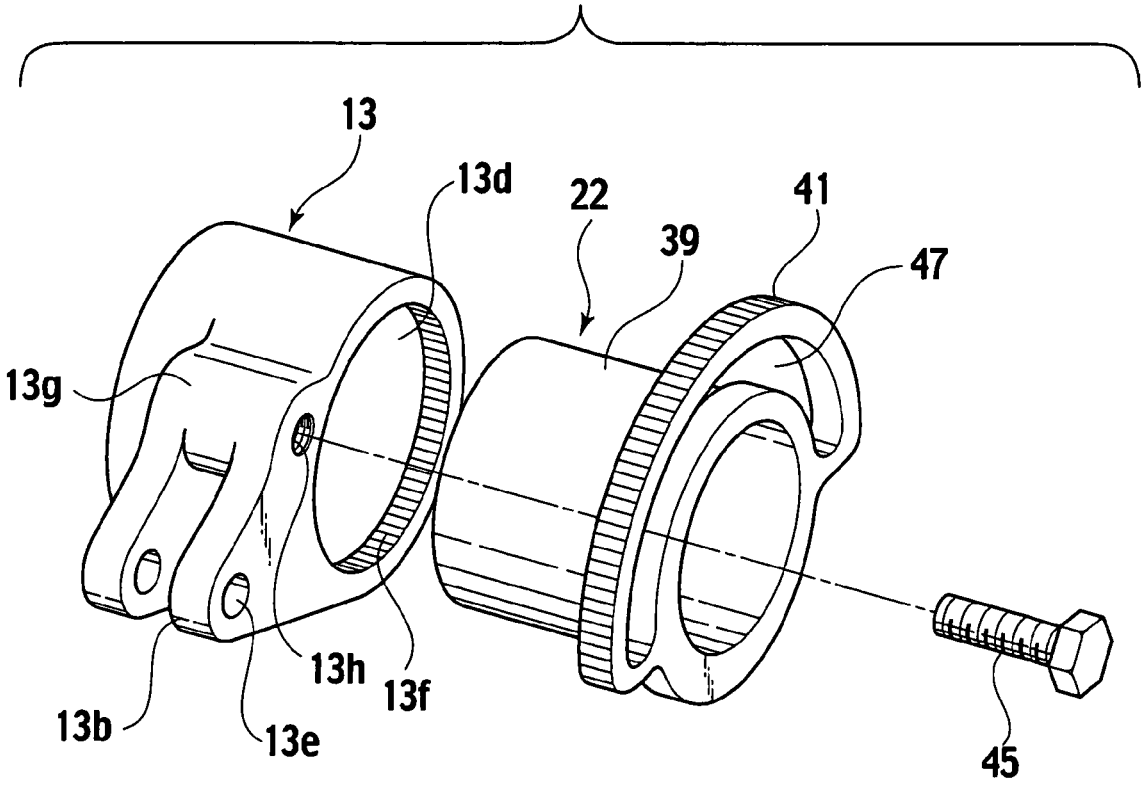
FIG. 4 is an exploded perspective view of the rocker arm and the eccentric bush taken along an arrow C in FIG. 1.

FIGS. 3 and 4 are exploded perspective views of the rocker arm 13 and the eccentric bush 22. FIG. 3 shows the state as viewed from an arrow B in FIG. 1, and FIG. 4 shows the state as viewed from an arrow C in FIG. 1.

The one end 13*a* projects from one outer end of the cylindrical base portion 13*c* of the rocker arm 13. The one end 13*a* is provided with a pin 16. The pin 16 is rotatably inserted into and connected to a through hole 14*d* formed in an end of the link arm 14. On the other hand, the other end 13*b* projects from the other outer side of the cylindrical base portion 13*c*. The other end 13*b* is formed with a through hole 13*e*. A connection pin 17 is inserted into the through hole 13*e* and a through hole 15*a* formed in an end of the link member 15, and the rocker arm 13 and the link member 15 are rotatably connected to each other.

The link arm 14 shown in FIGS. 1 and 2 includes a base 14*a* which is an annular one end having relatively large diameter, and a projecting end 14*b* which is the other end projecting from a predetermined position of an outer peripheral surface of the base 14*a*. A fitting hole 14*c* is formed in a central position of the base 14*a*. The fitting hole 14*c* is rotatably fitted over an outer peripheral surface of the drive cam 5. The pin hole 14*d* is formed in the projecting end 14*b*. The pin 16 is rotatably inserted into the pin hole 14*d*. An axis 16*a* of the pin 16 functions as a pivot point of the one end 13*a* of the rocker arm 13.

Both ends 15*b* and 15*c* of the link member 15 are respectively rotatably connected to the other end 13*b* of the rocker arm 13 and the cam nose 11 of the cam body 7*a* through the connection pin 17 and a connection pin 30.

Axes 17*d* and 30*a* of the connection pins 17 and 30 serve as pivot points of both ends 15*b* and 15*c* of the link member 15, the other end 13*b* of the rocker arm 13 and the cam nose 11 of the rocking cam 7.

As shown in FIG. 1, the control mechanism 9 includes a control shaft 32 which extends in parallel to the drive shaft 3 above the drive shaft 3 and in a longitudinal direction of the engine and which is rotatably supported by the bearing 4, the control cam 23 which serves as the rocking fulcrum of the rocker arm 13, a DC motor which controls the rotation of the control shaft 32 through a ball screw mechanism or a gear (both not shown), and a controller which controls the operation of the DC motor.

An axis of the control cam 23 is deviated from an axis of the control shaft 32 by a predetermined amount, and with this configuration, the valve-lift amount is variably controlled corresponding to variation of the engine operating state.

As shown in FIG. 2, the eccentric bush 22 is inserted into the support hole 13*d* of the rocker arm 13, and the position of an axis P2 of an outer peripheral circle of the eccentric bush 22 is deviated from an axis P1 (axis of an inner peripheral circle of the eccentric bush 22) by an amount $\alpha$ corresponding to a thick portion 39*a*.

As shown in FIGS. 3 and 4, the eccentric bush 22 includes a cylindrical portion 39 which is rotatably inserted into the control cam 23 of the control shaft 32 at its inner peripheral circle. The eccentric bush 22 can rock integrally with the rocker arm 13. The eccentric bush 22 can move in the axial direction with respect to the control cam 23 and the rocker arm 13. The cylindrical portion 39 is provided at its portion in the circumferential direction with the thick portion 39*a*. The cylindrical portion 39 is provided at its one end of the outer peripheral portion with an outer peripheral gear 39*b* over the entire circumference.

As shown in FIG. 4, an inner peripheral gear 13*f* is provided at one end of an inner surface of the support hole 13*d* of the rocker arm 13 over the entire circumference. If the cylindrical portion 39 of the eccentric bush 22 is inserted into the support hole 13*d* of the rocker arm 13, the outer peripheral gear 39*b* and the inner peripheral gear 13*f* mesh each other and couple to each other. That is, the outer peripheral gear 39*b* and the inner peripheral gear 13*f* constitute a coupling portion capable of switching between a state where the eccentric bush 22 and the rocker arm 13 can integrally rock and a state where the eccentric bush 22 and the rocker arm 13 can relatively rotate.

A driving gear 41 having a larger diameter than that of the cylindrical portion 39 is provided at a position of the cylindrical portion 39 closer to its end than the outer peripheral gear 39*b*. The driving gear 41 meshes with a pinion 43 which is connected to a drive shaft 36*a* of a valve-lift amount-adjusting motor 36 as a driving portion. That is, if the valve-lift amount-adjusting motor 36 is driven, the eccentric bush 22 rotates with respect to the control cam 23.

The driving gear 41 is provided on the cylindrical portion 39 over its half circumference. A gap 47 into which the fixing bolt 45 is to be inserted is provided between the outer peripheral surface of the cylindrical portion 39 and the driving gear 41. The rocker arm 13 is integrally provided at its other end 13*b* with a boss 13*g*. A screw hole 13*h* into which the fixing bolt 45 is to be threadedly engaged is formed in the boss 13*g*. If the fixing bolt 45 is inserted into the gap 47 and threadedly engaged with the screw hole 13*h*, the eccentric bush 22 and the rocker arm 13 are integrally coupled to each other to limit the relative movement in the axial direction.

The controller of the control mechanism 9 detects the current engine operating state by means of calculation or the like based on detection signals from various sensors such as a crank angle sensor, an air flowmeter, a water temperature sensor and a throttle opening sensor, and outputs a control signal to the DC motor based on a detection signal from a potentiometer which detects rotation position of the control shaft 32.

According to the valve operating mechanism, the DC motor rotates by the control signal from the controller when the engine speed and load are low, and the control shaft 32 rotates at the maximum through the gear and the ball screw mechanism in the clockwise direction in FIG. 2. Therefore, the axis P2 of the control cam 23 moves to a lower left rotation angle position as viewed in FIG. 2 with respect to the axis P1 of the control shaft 32. That is, the thick portion 23*a* moves from the drive shaft 3 toward the axis 16*a*. Thus, the entire rocker arm 13 rotates in the counterclockwise direction from the state shown in FIG. 2 and with this configuration, the cam nose 11 of each cam body 7*a* is forcibly lifted through the link member 15 and the entire cam body 7*a* rotates in the counterclockwise direction.

Thus, in the opening or closing operation of the suction valve 1 in this state, if the drive cam 5 rotates and one end 13*a* of the rocker arm 13 is bushed up through the link arm 14, the lift amount is transmitted to the rocking cam 7 and the valve lifter 6 through the link member 15, but the lift amount is sufficiently reduced.

When the valve-lift amount in the valve operating mechanism is varied between the cylinders, the adjustment of the valve-lift amount according to the present invention is carried out. That is, the fixing bolt 45 shown in FIG. 4 is removed, the eccentric bush 22 is moved in the axial direction with respect to the control cam 23 and the rocker arm 13, the meshed state between the outer peripheral gear 39*b* of the eccentric bush 22 and the inner peripheral gear 13*f* of the rocker arm 13 is released, and the coupled state therebetween is released.

An amount of movement of the eccentric bush 22 in the axial direction is in such a degree that the meshed state between the outer peripheral gear 39*b* and the inner peripheral gear 13*f* is released. In this released state, the cylindrical portion 39 can rotate and axially move between the outer peripheral surface of the control cam 23 and the support hole 13*d* of the rocker arm 13.

Figure 5A:
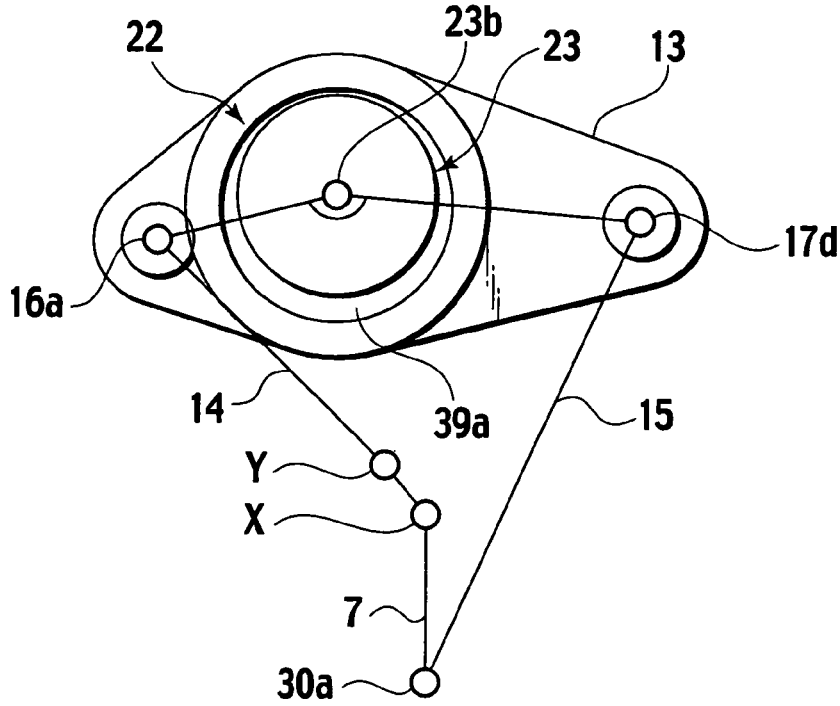
FIGS. 5A and 5B are diagrams showing states before and after adjustment, respectively.
Figure 5A:
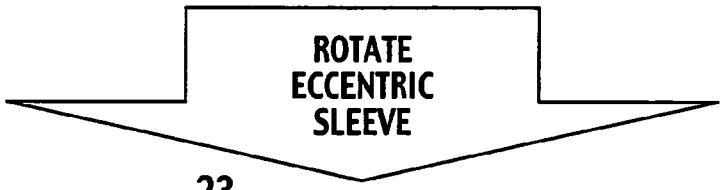
Figure 5B:
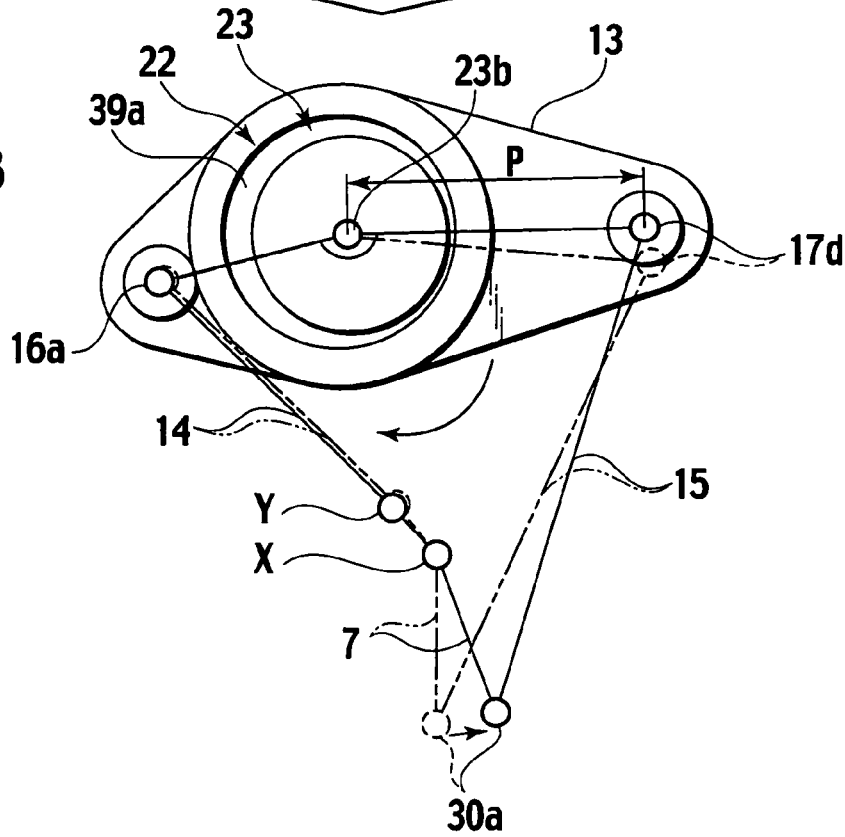

In this state, the valve-lift amount-adjusting motor 36 is driven to rotate the eccentric bush 22 by a predetermined amount. FIG. 5A is a diagram showing one example of this state before adjustment, and FIG. 5B is a diagram showing the state after the adjustment. In this adjustment operation, the valve-lift amount is reduced from FIG. 5A to FIG. 5B. The link position shown with a phantom line in FIG. 5B corresponds to a link position of FIG. 5A.

That is, if the eccentric bush 22 is rotated in the clockwise direction in the drawings from the state before adjustment shown in FIG. 5A, the rocker arm 13 rotates in the counterclockwise direction from the state shown in FIG. 5A. With this configuration, the cam nose 11 of each cam body 7*a* is forcibly pulled up through the link member 15, and the entire cam body 7*a* rotates in the counterclockwise direction. As a result, the state is shifted to the state after adjustment shown in FIG. 5B.

In the state after adjustment shown in FIG. 5B, as compared with the state before adjustment shown in FIG. 5A, a link length P connecting a center 23*b* of the control cam 23 and the axis 17*d* of the connection pin 17 to each other is shortened by a length corresponding to a distance through which the thick portion 39*a* is separated from the axis 17*d*, and the axis 17*d* is located above the thick portion 39*a*. With this configuration, the axis 30*a* of the connection pin 30 in the cam nose 11 also moves rightwards lightly upward.

When adjustment is carried out to increase the lift amount, the eccentric bush 22 is rotated in the counterclockwise direction in FIG. 5A from the state shown in FIG. 5A. With this configuration, the link member 15 is lowered, the rocking cam 7 is rotated in the clockwise direction in FIG. 2, and the lift amount can be increased.

According to this embodiment, when the valve-lift amount is to be adjusted, the eccentric bush 22 provided between the rocker arm 13 and the control cam 23 is rotated in a state where the eccentric bush 22 is detached from the rocker arm 13. Since it is unnecessary to assemble after the valve operating mechanism is assembled, limitation of operation space is reduced, the adjusting operation of the lift amount becomes extremely easy, and producing cost can be reduced.

Figure 6:
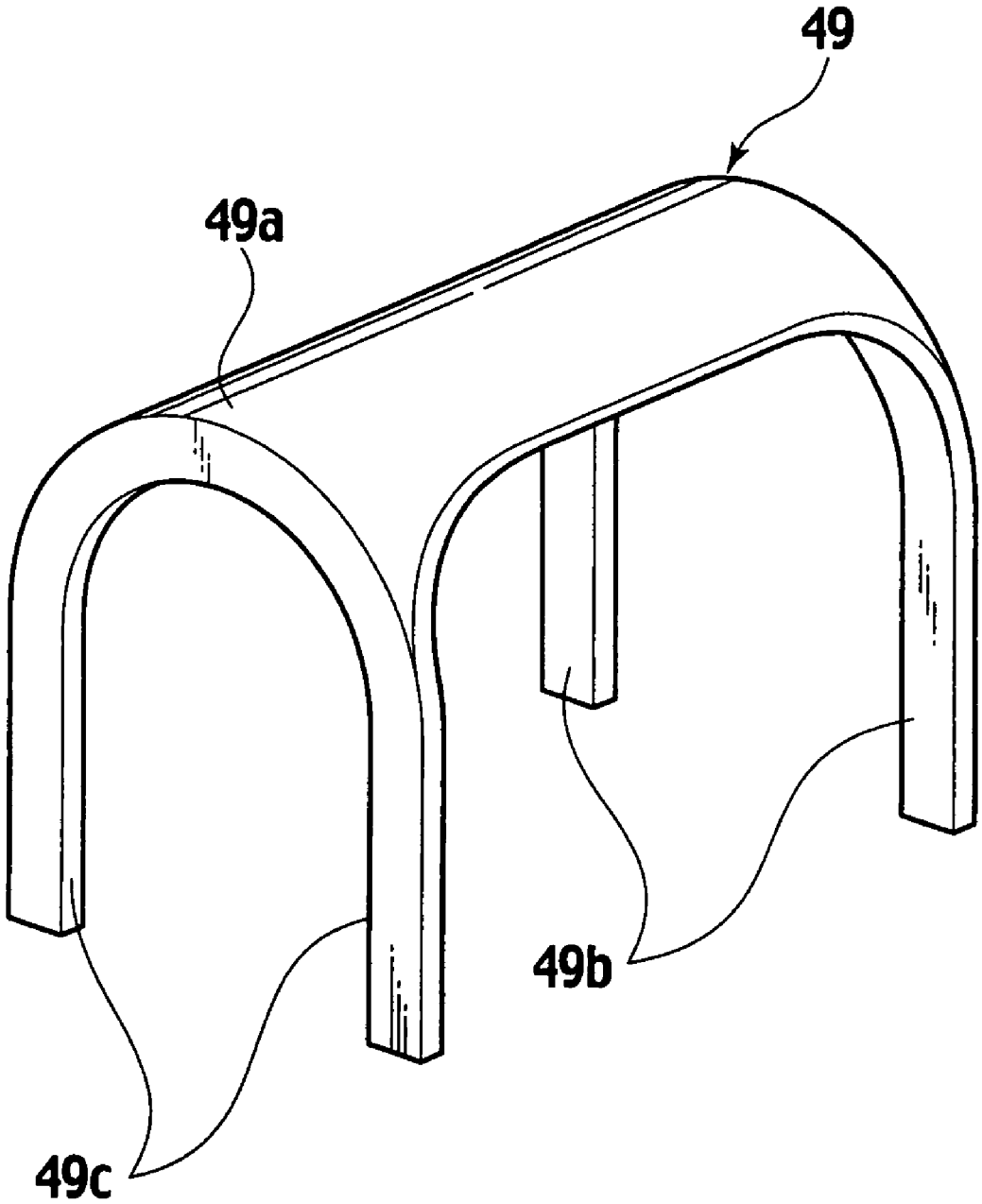
FIG. 6 is a perspective view of a bush detent member used as a fixing unit that fixes the rocker arm and the eccentric bush to each other.

As means for fixing the eccentric bush 22 and the rocker arm 13 to each other, a bush detent member 49 shown in FIG. 6 can also be used instead of the fixing bolt 45 shown in FIG. 4.

Each bush detent member 49 includes a cover 49*a* which covers a portion of an outer peripheral surface of the rocker arm 13. The bush detent member 49 also includes two detent arms 49*b* which are located at both ends of the cover 49*a* in its axial direction and which cover one end of the eccentric bush 22 in a state where the cylindrical portion 39 of the eccentric bush 22 is inserted into the support hole 13*d* of the rocker arm 13, and two detent arms 49*c* which cover the other end of the rocker arm 13.

When the bush detent member 49 is put on the rocker arm 13 from above the rocker arm 13, the bush detent member 49 is put from the opposite side from the driving gear 41 provided on the eccentric bush 22.

According to the present invention, the coupling portion comprises an outer peripheral gear provided on the outer peripheral surface of the eccentric bush, and an inner peripheral gear which can mesh with the outer peripheral gear and which is provided on the inner peripheral surface of the rocker arm. The eccentric bush can move in the axial direction with respect to the rocking support shaft. The outer peripheral gear and the inner peripheral gear are displaced between a meshed state and a non-meshed state. Therefore, the eccentric bush and the rocker arm can be coupled reliably, and they can easily be displaced between the meshed state and the non-meshed state.

The driving portion which rotates the eccentric bush in which the outer peripheral gear and the inner peripheral gear are in the non-meshed state with respect to the rocking support shaft. Therefore, the eccentric bush can easily be rotated.

The driving portion is provided with the pinion, and the eccentric bush is provided with a gear which meshes with the pinion. Thus, power can reliably be transmitted from the driving portion to the eccentric bush.

The rocking support shaft is provided with the eccentric cam which is deviated from the axis of the rocking support shaft and which rotates when the rocking support shaft rotates, thereby varying the valve-lift amount. The eccentric bush is rotatably provided on the outer periphery of the eccentric cam. Therefore, the valve-lift amount in the variable valve operating mechanism can be adjusted without disassembling the valve operating mechanism after it is assembled, and the valve-lift amount can be adjusted easily.

The eccentric bush includes the cylindrical portion which is located between the rocker arm and the eccentric cam in the meshed state and the non-meshed state between the outer peripheral gear and the inner peripheral gear. Therefore, when the valve-lift amount is adjusted, the cylindrical portion can slidably rotate between the rocker arm and the eccentric cam.

Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

The entire content of a Patent Application No. TOKUGAN 2004-070864 with a filing date of Mar. 12, 2004, is hereby incorporated by reference.

What is claimed is:

1. A valve-lift amount adjusting mechanism of an internal combustion engine in which a rocker arm is rocked with respect to a rocking support shaft when a camshaft rotates, a rocking cam provided on the camshaft is rocked when the rocker arm rocks, thereby opening and closing a valve, wherein the rocker arm is rockably supported with respect to the rocking support shaft through an eccentric bush, a coupling portion is provided between the eccentric bush and the rocker arm, the coupling portion can switch between a state where the eccentric bush and the rocker arm can integrally rock with respect to the rocking support shaft and a state where the eccentric bush and the rocker arm can relatively rotate.

2. The valve-lift amount adjusting mechanism of an internal combustion engine according to claim 1, wherein the coupling portion comprises an outer peripheral gear provided on an outer peripheral surface of the eccentric bush and an inner peripheral gear which can mesh with the outer peripheral gear and which is provided on an inner peripheral surface of the rocker arm, the eccentric bush can move in an axial direction with respect to the rocking support shaft and which displaces the outer peripheral gear and the inner peripheral gear between a meshed state and a non-meshed state.

3. The valve-lift amount adjusting mechanism of an internal combustion engine according to claim 2, wherein the eccentric bush in which the outer peripheral gear and the inner peripheral gear are brought into the non-meshed state is provided with a driving portion which rotates the eccentric bush with respect to the rocking support shaft.

4. The valve-lift amount adjusting mechanism of an internal combustion engine according to claim 3, wherein the driving portion is provided with a pinion, the eccentric bush is provided with a gear which meshes with the pinion.

5. The valve-lift amount adjusting mechanism of an internal combustion engine according to claim 1, wherein the rocking support shaft is provided with an eccentric cam which is eccentric with respect to an axis of the rocking support shaft and which rotates when the rocking support shaft rotates, thereby varying a valve-lift amount, the eccentric bush is rotatably provided on an outer periphery of the eccentric cam.

6. The valve-lift amount adjusting mechanism of an internal combustion engine according to claim 5, wherein the eccentric bush includes a cylindrical portion located between the rocker arm and the eccentric cam in a meshed state and a non-meshed state between the outer peripheral gear and the inner peripheral gear.

7. A valve-lift amount adjusting method of an internal combustion engine in which a rocker arm is rocked with respect to a rocking support shaft when a camshaft rotates, a rocking cam provided on the camshaft is rocked when the rocker arm rocks, thereby opening and closing a valve, wherein the rocker arm is rockably supported with respect to the rocking support shaft through an eccentric bush, in a state where the eccentric bush is integrally coupled to the rocker arm through a coupling portion, the eccentric bush releases a coupled state of the coupling portion and switches a state where the eccentric bush can rock together with the rocker arm with respect to the rocking support shaft to a state where the eccentric bush and the rocker arm can relatively rotate, and in this released state, the eccentric bush is rotated with respect to the rocker arm by a predetermined angle and then, the eccentric bush and the rocker arm are integrally coupled to each other by the coupling portion.

* * * * *